US005133611A

United States Patent [19]

Nakajima

[11] Patent Number: 5,133,611

[45] Date of Patent: Jul. 28, 1992

[54] RECORDING APPARATUS

[75] Inventor: Masuyuki Nakajima, Tokyo, Japan

[73] Assignee: Canon Kabushiki Kaisha, Tokyo, Japan

[21] Appl. No.: 599,866

[22] Filed: Oct. 19, 1990

[30] Foreign Application Priority Data

Oct. 19, 1989 [JP] Japan ..... 1-270421
Oct. 19, 1989 [JP] Japan ..... 1-270422
Oct. 19, 1989 [JP] Japan ..... 1-270423

[51] Int. Cl.[5] ..... B41J 3/02

[52] U.S. Cl. ..... 400/120; 400/56; 400/708; 346/76 PH; 346/140 R

[58] Field of Search ..... 400/120, 707.5, 708, 400/708.1, 712, 56; 346/76 PH, 140 R

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,563,690 | 1/1986 | Tomita et al. | 400/608.2 |
| 4,647,233 | 3/1987 | Noda et al. | 400/120 HE |
| 4,702,632 | 10/1987 | Taketani | 400/708 |
| 4,723,129 | 2/1988 | Endo et al. | 346/1.1 |
| 4,740,796 | 4/1988 | Endo et al. | 346/1.1 |

FOREIGN PATENT DOCUMENTS

| | | | |
|---|---|---|---|
| 3032858 | 3/1981 | Fed. Rep. of Germany | 400/120 HE |
| 3709127 | 10/1987 | Fed. Rep. of Germany | 400/708 |
| 54-56847 | 5/1979 | Japan . | |
| 0041203 | 3/1980 | Japan | 400/708 |
| 0164184 | 12/1980 | Japan | 400/707.5 |
| 0162362 | 9/1983 | Japan | 400/707.5 |
| 59-123670 | 7/1984 | Japan . | |
| 59-138461 | 8/1984 | Japan . | |
| 60-71260 | 4/1985 | Japan . | |
| 0032774 | 2/1986 | Japan | 400/708 |
| 0137765 | 6/1986 | Japan | 400/120 HE |
| 0164869 | 7/1986 | Japan | 400/708 |
| 0197265 | 9/1986 | Japan | 400/708 |
| 0263782 | 11/1986 | Japan | 400/707.5 |
| 0071674 | 4/1987 | Japan | 400/708 |
| 0001564 | 1/1988 | Japan | 400/708 |
| 0011369 | 1/1988 | Japan | 400/708 |
| 0037973 | 2/1988 | Japan | 400/120 HE |
| 0077751 | 4/1988 | Japan | 400/120 HE |
| 0147671 | 6/1988 | Japan | 400/708 |
| 0230374 | 9/1988 | Japan | 400/120 HE |

OTHER PUBLICATIONS

"Multiple Alarm Tones From a Stepper Motor" IBM Tech. Discl. Bulletin, vol. 28, No. 6, Nov. 1985, pp. 2358-2359.

*Primary Examiner*—Eugene H. Eickholt
*Attorney, Agent, or Firm*—Fitzpatrick, Cella, Harper & Scinto

[57] ABSTRACT

There is disclosed a recording apparatus for image recording on a recording sheet, in which a releasing member is provided for releasing the recording head from the platen roller, and the sheet setting operation is conducted by the platen roller while the recording head is released, in order to reduce the load on the driving force of the platen roller. The releasing member can assume a locked position, in which the operator can use both hands for other operations, or an unlocked position, in which the recording head automatically returns to the recording position after sheet setting.

21 Claims, 10 Drawing Sheets

| |
|---|
| FIG. 9A |
| FIG. 9B |

RECORDING APPARATUS

BACKGROUND OF THE INVENTION

1. Field of the Invention

The present invention relates to a recording apparatus for recording on a recording sheet, and more particularly to such recording apparatus allowing easy setting of the recording sheets.

2. Related Background Art

Among the thermal recording methods currently utilized, there is known a recording method of pressing a thermal recording head to a platen roller across a thermosensitive paper, or an ordinary paper and an ink ribbon. Image recording on the recording sheet is achieved by advancing the thermo-sensitive paper or ordinary paper between the platen roller and the recording head by the rotation of the platen roller and causing the recording head to generate heat in synchronization with the sheet advancement.

In setting of the recording sheet in the apparatus of such recording method, if the recording head and the platen roller are maintained in contact, the recording head is rubbed with the platen roller under friction when it is rotated, thus giving an excessive load on a driving motor for rotating the platen roller and causing unnecessary abrasion of the recording head.

For this reason there has been provided a release lever for releasing the recording head from the platen roller, and the setting of the recording sheet has been achieved by manipulating the release lever to separate the recording head from the platen roller, and rotating the platen roller for example with a manual knob to advance the leading end of the recording sheet to the recording position.

However, in such setting of the recording sheet with the manual knob, the position of leading end of the recording sheet cannot be made constant as it is determined by visual observation.

Some of the recent apparatus are provided with an automatic sheet feeding switch, which, when manipulated, automatically feeds the recording sheet. However, such apparatus is still unsatisfactory in operability, as the operator has to make two operations, namely operation of the release lever and operation of said automatic feeding switch, in the setting of the recording sheet.

For avoiding such drawback, there is also already known an apparatus in which a release lever, for releasing the recording head from the platen roller, is manipulated and locked to maintain the recording head and the platen roller in a separated state, and an automatic feeding switch is then manipulated to automatically feed the recording sheet.

In such structure, however, the operator may forget to return the release lever, after the sheet setting and before the recording operation. In such case the recording operation may be conducted without image formation, as the recording head is not in contact with the recording sheet.

For avoiding such drawback, there is further known an apparatus equipped with a release lever for releasing the recording head from the platen roller, whereby the recording head is separated from the platen roller at the setting of the recording sheet.

In such structure, however, if the released state is eventually cancelled in the course of sheet feeding, there will be generated a sudden change in the load of the motor for driving the platen roller thus disabling exact sheet feeding.

SUMMARY OF THE INVENTION

An object of the present invention is to provide a recording apparatus capable of exact feeding of recording sheet, thereby enabling clear image recording.

Another object of the present invention is to provide a recording apparatus with improved operability at the setting of the recording sheet.

Still another object of the present invention is to provide a recording apparatus capable, at the setting of the recording sheet, of improving the operability and achieving exact positioning of the leading end of the sheet.

Still another object of the present invention is to provide a recording apparatus capable of exact sheet setting even when the released state of the release lever is cancelled in the course of feeding of the recording sheet.

Still another object of the present invention is to provide a recording apparatus which is compact and is improved in operability, capable of preventing eventual failure in the returning of the releasing means.

Still another object of the present invention is to provide a recording apparatus which, when the recording sheet is inserted while the recording head is released from the platen roller by the manipulation of the release lever, detects such insertion and automatically drives the platen roller, thereby setting the recording sheet.

Still another object of the present invention is to provide a recording apparatus capable of exact positioning of leading end of the recording sheet, by transporting the recording sheet by a predetermined amount from the position of a registration sensor.

Still another object of the present invention is to provide a recording apparatus in which the sheet feeding operation is interrupted if the released state between the recording means and the sheet transporting means is cancelled in the source of sheet feeding operation, thereby preventing the sudden change in the load of the motor, and which is capable of exact positioning of the leading end of the sheet by restarting the sheet setting operation when the released state is restored.

Still another object of the present invention is to provide a recording apparatus in which releasing means for releasing the recording means from the transporting means can be maintained in a locked state for example in case of jamming of the recording sheet, whereby the operator can use both hands for handling the jammed sheet.

Still another object of the present invention is to provide a recording apparatus in which release means is composed of a lever that can assume a locked state and an unlocked state according to the direction of rotation thereof, without increase in the number of component parts.

Still another object of the present invention is to provide a recording apparatus in which the operation state of the release means is detected by a sensor and the recording means and transporting means are driven according to the result of the detection, thereby preventing errors in the operation without increase in the number of sensors.

DETAILED DESCRIPTION OF THE PREFERRED EMBODIMENTS

Now the present invention will be clarified in detail by preferred embodiments thereof.

Following embodiment is applied, as an example of recording apparatus, to so-called handy terminal utilized for data processing at site.

Figure 1:
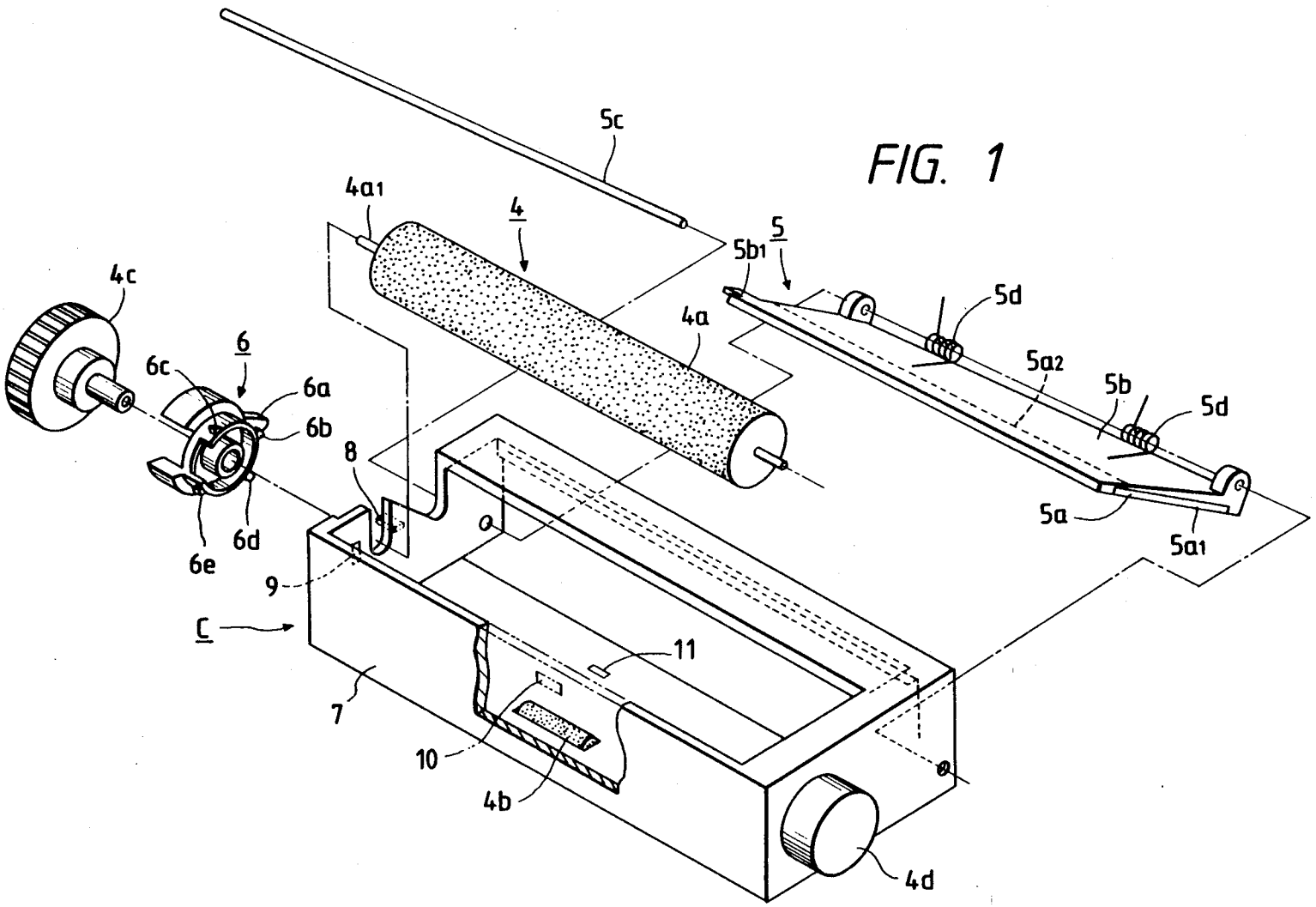
FIG. 1 is an exploded perspective view of a recording apparatus embodying the present invention.
Figure 2:
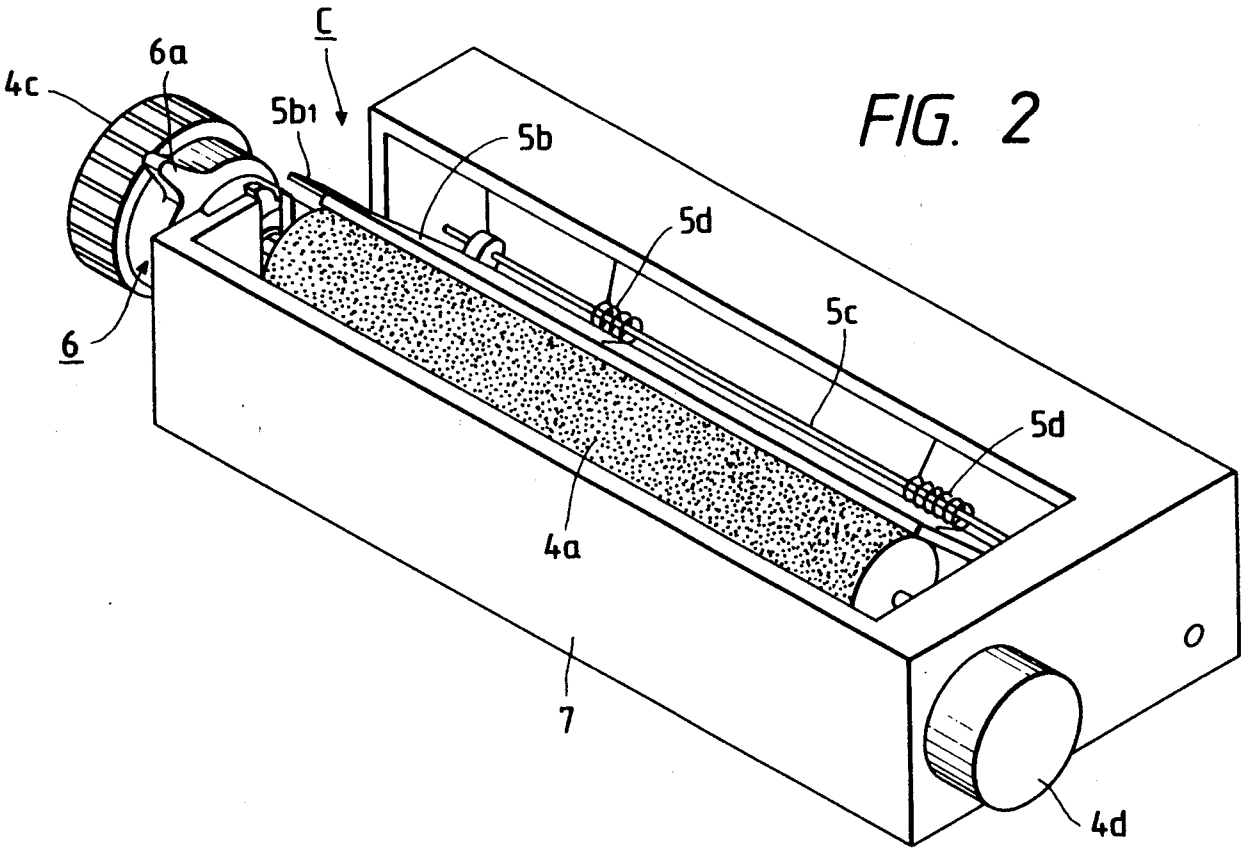
FIG. 2 is a perspective view of the recording apparatus.
Figure 3:
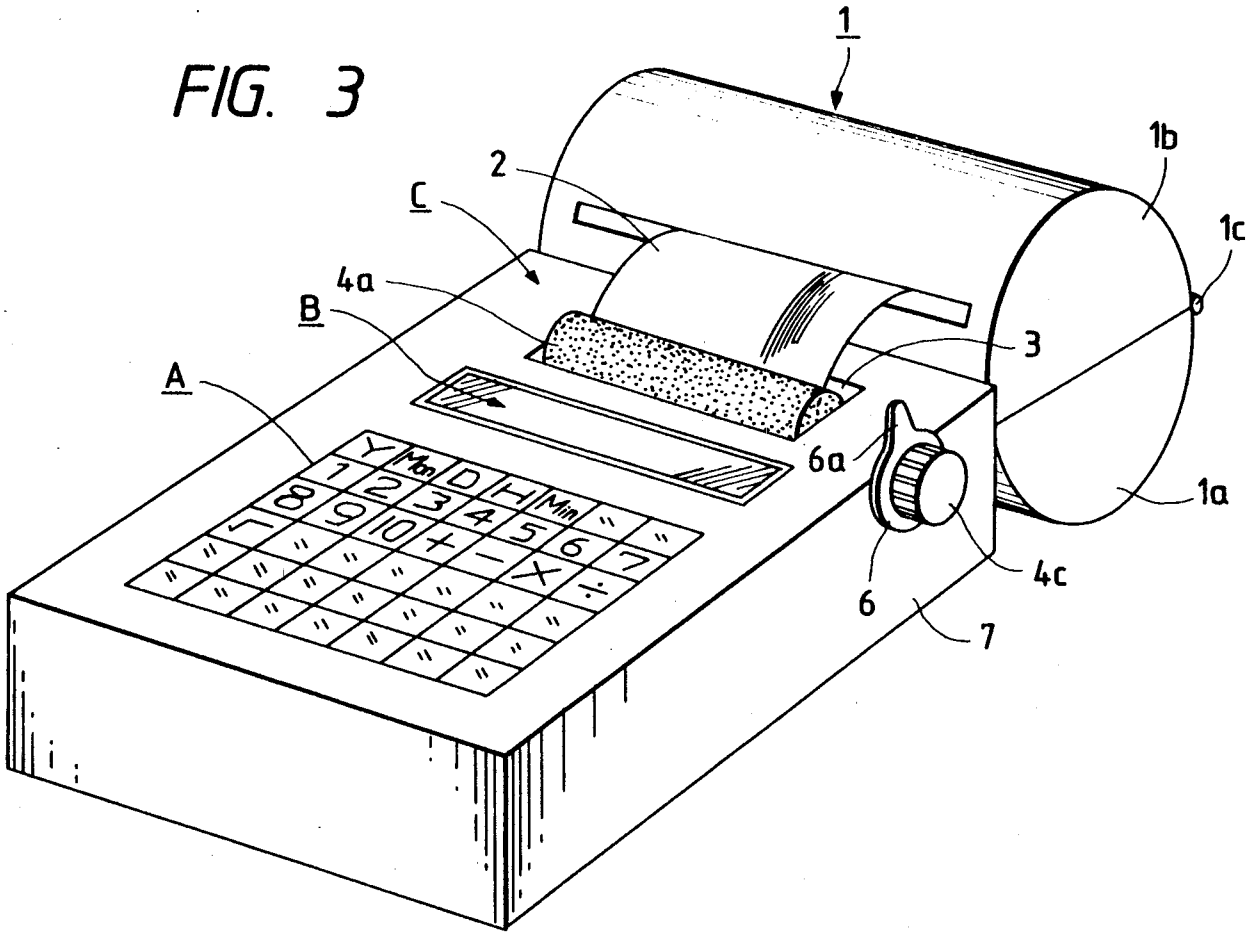
FIG. 3 is a perspective view of a handy terminal.
Figure 4:
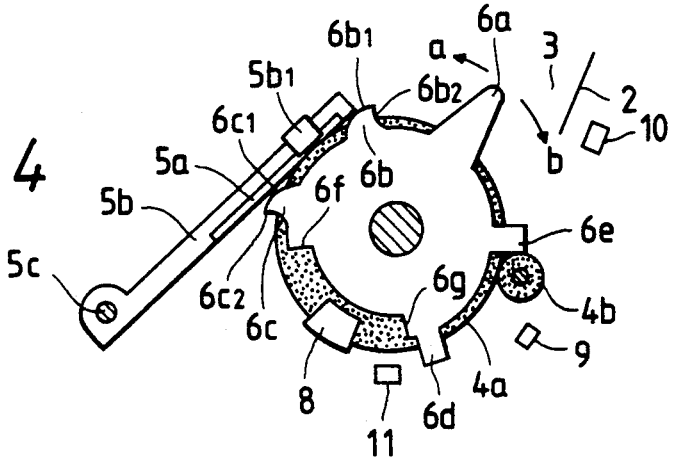
FIG. 4 is a schematic cross-sectional view of a recording state in which a recording head is maintained in pressure contact with a transport roller.

FIG. 1 is an exploded perspective view of a recording unit used in a handy terminal; FIG. 2 is a perspective view of the recording unit; FIG. 3 is a schematic perspective view of the entire handy terminal; and FIG. 4 is a schematic cross-sectional view.

[Description of entire structure]

In the apparatus shown in FIG. 3, information entered from a keyboard A constituting an input unit is displayed on a display unit B, and desired information can be recorded with a recording unit C. In a keyboard A, symbols Y, Mon, D, H and Min respectively stand for year, month, date, hour and minute.

In said recording mechanism C, as shown in FIGS. 1 and 3, a thermosensitive recording sheet 2 is housed in a roll holder 1 detachably mounted on the main body of the recording apparatus. The recording sheet 2 is inserted into an entrance slot 3 and transported by sheet transport means 4, and recording means 5 is activated in synchronization with the sheet transportation to form a desired record on the recording sheet 2.

In the recording mechanism C, there is provided release means 6 for releasing the recording means 5 from the sheet transport means 4, and the recording sheet 2 is automatically fed by control means to be explained later, according to the operation state of the release means 6.

In the following there will be given detailed explanation on the units constituting the recording mechanism C.

[Sheet transport means]

The sheet transport means 4 is composed of a transport roller (platen roller) 4*a* constituting a transporting rotary member, and a pinch roller 4*b* as follower rotary member and pressed to the platen roller by means of biasing means such as a plate spring (not shown). A shaft $4a_1$ of the roller is provided, at an end thereof, with a manual knob 4*c*, and, at the other end, with a transport motor 4*d* composed of a stepping motor.

The recording sheet 2, composed of an elongated thermosensitive sheet capable of generating color upon heating, is wound as a roll and housed in a roll holder 1 as shown in FIG. 3. The roll holder 1 is composed of a lower case 1*a* and an upper case 1*b* which are mutually articulated by a shaft 1*c*, and the lower case 1*a* is detachably mounted on the main body 7 of the recording apparatus, by means for example of unrepresented hooks.

For effecting the recording, the roll holder 1 containing the recording sheet 2 is mounted on the recording apparatus, and the recording sheet 2; is inserted into the entrance slot 3. Then, when the transport motor 4*d* is activated, the transport roller 4*a* is rotated and the pinch roller 4*b* is followed and driven by the transport roller, and the recording sheet 2 is advanced along the periphery of the transport roller 4*a* by the cooperation of the rollers.

[Recording means]

The recording means 5 in the present embodiment is composed of a thermal recording head 5*a* generating heat according to image signal. More specifically, the recording head 5*a* is so-called line type recording head having, on the surface of a head substrate $5a_1$, a linear array of plural heat generating elements $5a_2$ capable of heat generation by electric current supply, arranged in the transversal direction of the recording sheet 2 (perpendicular to the transport direction thereof). The recording head 5*a* is mounted on a head holder 5*b*.

The head holder 5*b* is rotatably mounted, by a shaft 5*c*, on the main body 7, and is biased under pressure toward the transport roller 4*a* by means of torsion springs 5*d* mounted on the shaft 5*c*.

The recording head 5*a* is so constructed that the heat generating elements $5a_2$ thereof come into contact under pressure with the transport roller 4*a*. The transport roller 4*a* also functions as a platen, at the recording, for supporting the rear surface of the recording sheet 2 pressed by the recording head 5*a*.

Thus the transportation of the recording sheet 2 by the transport roller 4*a* and the synchronized energization of the heat generating elements $5a_2$ cause patternwise color formation on the recording sheet 2, thereby achieving image recording thereon.

[Release means]

The release means 6, for releasing the recording head 5*a*, maintained in contact under pressure with the transport roller 4*a*, from the transport roller 4*a*, is composed of a release lever in the present embodiment. The releasing of the recording head 5*a* from the transport roller 4*a* includes, not only the complete separation of the two as in the present embodiment, but also a reduction in the pressure between the recording head 5*a* and the transport roller 4*a*. Thus this is an operation for reducing the load on the transport motor 4*d*, resulting from the contact of the recording head 5*a*, in the rotation of the transport roller 4*a*.

The release lever 6 is rotatably mounted on the shaft $4a_1$ of the transport roller 4*a*, and can be rotated by a protruding knob member 6*a*. the knob member 6*a* is provided, on an inside circular peripheral part thereof, with a locking projection 6*b*, a releasing projection 6*c*, and two sensor projections 6*d*, 6*e* at predetermined positions, as shown in FIGS. 1 and 4.

The main body 7 is provided with a stopper projection 8 which engages with a notch 6*f* formed on the release lever 6 when it is rotated in a direction a, or with a notch 6*g* when the lever 6 is rotated in a direction b, thereby limiting the rotatable range of the release lever 6.

Figure 5:
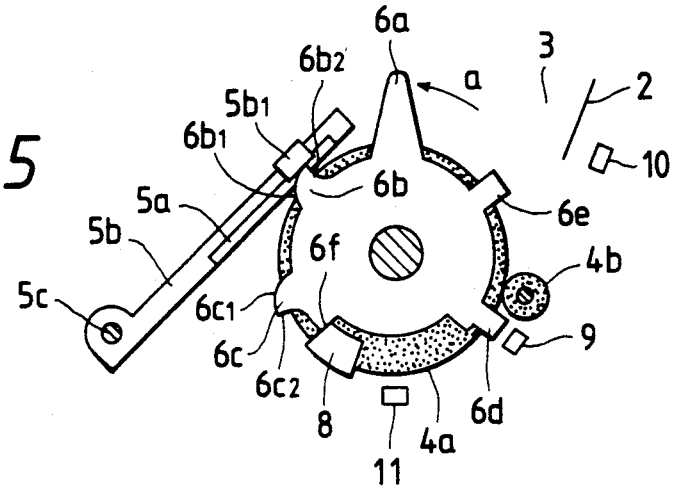
FIG. 5 is a cross-sectional view of a state in which a release lever is manipulated and maintained in a locked state.

The locking projection 6*b* is composed of an arc part $6b_1$ and a straight part $6b_2$, and the radius to the top thereof is made larger than that of the transport roller 4*a*. Thus, when the release lever 6 is rotated in the direction a, the periphery of the arc part $6b_1$ engages with an engaging part $5b_1$ projecting at an end of the head holder 5*b*, thus pushing up the head holder 5*b* along the periphery of the arc part $6b_1$, thereby separating the recording head 5*a* from the periphery of the transport roller 4*a* as shown in FIG. 5.

When the release lever 6 is rotated until the notch 6*f* engages with the stopper projection 8, the top of the locking projection 6*b* engages with the engaging part $5b_1$ and is pressed toward the center of rotation by the biasing force of the recording head 5*a*, so that the release lever 6 is maintained in this position even when the hand of the operator is released from the knob 6*a*. Thus the transport roller 4*a* and the recording head 5*a* are locked in a mutually separated state. Consequently the removal of jammed sheet 2 or the insertion of strongly curled sheet can be easily done with both hands, with the apparatus in the locked state and placed for example on a table.

Figure 6:
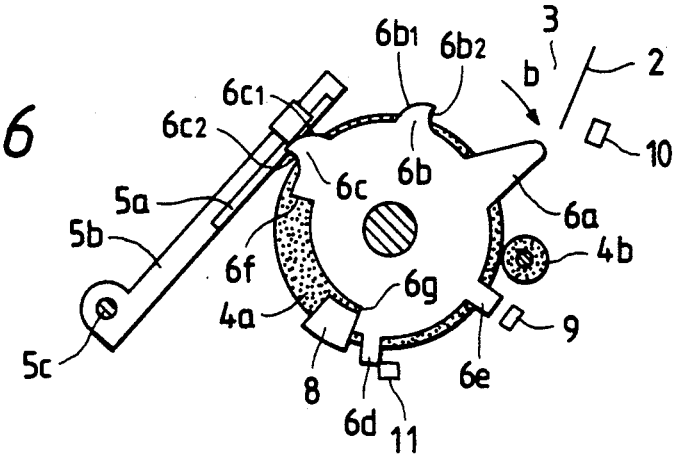
FIG. 6 is a cross-sectional view of a state in which the release lever is manipulated into an unlocked state.

The releasing projection 6*c* is also composed of an arc part $6c_1$ and a straight part $6c_2$, and the radius to the top is made larger than that of the transport roller 4*a*. Consequently, when the release lever 6 is rotated in the direction b, the periphery of the arc part $6c_1$ engages with the engaging part $5b_1$ of the head holder 5*b*, thus pushing up the head holder 5*b* along the periphery of the arc part $6c_1$ as shown in FIG. 6, thus separating the recording head 5*a* from the transport roller 4*a*.

However, even when the release lever 6 is rotated until the notch 6*g* comes into contact with the stopper projection 8, the engaging part $5b_1$ is still in contact with the arc part $6c_1$ of the releasing projection 6*c* and does not reach the top thereof. Thus, when the knob 6*a* is released, the release lever 6 rotates in the direction a by the biasing force of the recording head 5*a* on the arc part $6c_1$, whereby the recording head 5*a* comes again into contact with the transport roller 4*a*. Therefore, after mutual separation of the recording head 5*a* and the transport roller 4*a* for sheet setting, the recording head 5*a* automatically returns to the contracting state with the transport roller 4*a* when the lever 6 is released, so that there can be avoided defective function resulting from forgotten returning of the release lever 6.

In summary, by the rotation of the release lever 6 in a direction, the recording head 5*a* and the transport roller 4*a* are mutually separated and are locked in such separated state even after the knob 6*a* is released. On the other hand, by the rotation in the other direction, the recording head 5*a* and the transport roller 4*a* are similarly separated but return to mutually contacting state when the knob 6*a* is released.

Since the pinch roller 4*b* is not separated from the transport roller 4*a* by the rotation of the release lever 6, the recording sheet 2 can be transported even when the recording head 5*a* is separated from the transport roller 4*a*.

[Detection of operation state of release lever]

The operation state of the release lever 6 is detected by a sensor.

More specifically, as shown in FIG. 1, a release sensor 9 composed of a photosensor is provided in the vicinity of the release lever 6. When the release lever 6 is rotated in the direction a until the notch of engages with the stopper projection 8, the sensor projection 6*d* is in a position opposed to the release sensor 9, as shown in FIG. 5. Also as shown in FIG. 6, when the release lever 6 is rotated in the direction b until the notch 6*g* engages with the stopper projection 8, the sensor projection 6*e* is in a position opposed to the release sensor 9.

Said sensor projections 6*d*, 6*e* are provided, at the ends thereof, with light reflecting parts for reflecting the light from the release sensor 9.

Thus, when the transport roller 4*a* and the recording head 5*a* are in the mutually contacting state as shown in FIG. 4, the release sensor 9 is turned off. When the recording head 5*a* is separated from the transport roller 4*a* by the rotation of the release lever 6, the sensor projection 6*d* or 6*e* is brought to the opposed position to the release sensor 9, thereby turning on the release sensor 9. In this manner the operation state of the release lever 6 for contacting or separating the transport roller 4*a* and the recording head 5*a* can be detected by a single sensor 9, whereby space saving and cost reduction can be achieved.

The release sensor 9, composed of a photosensor in the present embodiment, may also be composed of a touch sensor, a combination of a hall element and a magnet, or a mechanical switch.

[Detection of recording sheet]

As shown in FIG. 4, a sheet sensor 10 is provided at the entrance slot 3, for detecting the presence of the recording sheet 2. The sheet sensor 10 is turned on when the recording sheet 2 is inserted into the entrance slot 3 and is positioned at the sensor, but is turned off in the absence of the recording sheet 2. Thus the sheet sensor 10 can detect whether the recording sheet 2 has been inserted into the entrance slot 3.

Also a registration sensor 11 is provided on the transport path of the recording sheet 2 and at the downstream side, in the transporting direction thereof, of the pinch roller 4*b* which is at the downstream side of the sheet sensor 10. The registration sensor 11 is turned on or off respectively when the recording sheet 2 is present or absent at the position of the sensor.

Consequently, when the registration sensor 11 is turned on, the recording sheet 11 is securely supported by the transport roller 4*a* and the pinch roller 4*b*, so that the leading end of the sheet can be exactly positioned for recording, by advancing the recording sheet 2 by a predetermined amount after the sensor 11 is turned on.

The structure of the mechanism can be simplified since the pinch roller 4*b* need not be separated from the transport roller 4*a*.

The sheet sensor 10 and registration sensor 11, composed of photosensors in the present embodiment, may be composed of other sensors such as touch sensors.

[Control means]

Figure 7:
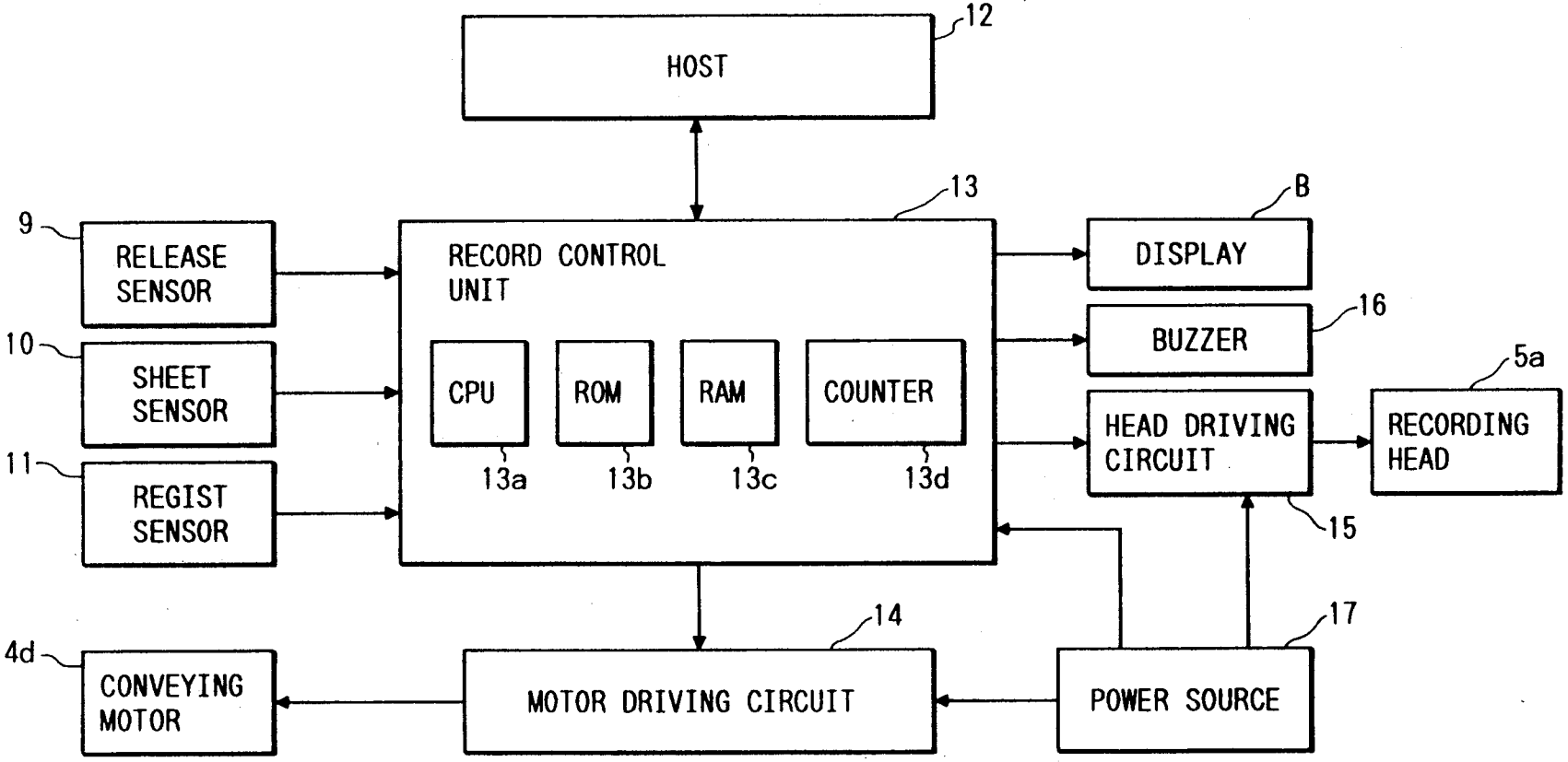
FIG. 7 is a block diagram of a control system.

Now reference is made to a block diagram shown in FIG. 7, for explaining the structure for controlling the functions of the aforementioned various means. A recording control unit 13, connected to a host computer 12, is provided with a CPU 13*a* such as a microprocessor, a ROM 13*b* storing a control program of the CPU 13*a* and various data, a RAM 13*c* used as a work area of the CPU 13*a* and for temporary storage of various data, a counter 13*d* for counting the number of rotation pulses of the transport motor 4*d* etc.

The control unit 13 receives information from the release sensor 9, sheet sensor 10, registration sensor 11 etc., and sends drive signals to a motor driving circuit 14 for driving the transport motor 4*d* and a head driving circuit 15 for driving the recording head 5*a*. It also releases message signals to a display B and a drive signal to a buzzer 16 constituting alarm means in response to various input signals.

A power source 17 is provided for driving the transport motor 4*d* and the recording head 5*a*.

In the following there will be explained, with reference to a flow chart shown in FIG. 8, the control sequence by the control means for setting the recording sheet 2 in the recording apparatus.

At first a step S1 discriminates whether the registration sensor 11 is on. If it is on, indicating a state that the recording sheet 2 remains at the position of the registration sensor 11, the sheet setting operation is not conducted, and the sequence proceeds to a step S2 for displaying an error message on the display B.

If said step S1 identifies that the registration sensor 11 is off, indicating the absence of the recording sheet 2 at the sensor 11, a step S3 discriminates whether the sheet sensor is on. If it is on, indicating the presence of the recording sheet 2 at the entrance slot 3, the sheet setting operation is not conducted and the sequence proceeds to the step S2 for displaying the error message on the display B. Thus, if the recording sheet 2 is already set, the sheet feeding operation is not conducted by the manipulation of the release lever 6.

If the step S3 identifies that the sheet sensor 10 is off, indicating the absence of the recording sheet 2 at the entrance slot 3, a step S4 discriminates whether the release sensor 9 is on. If it is off, indicating that the recording head 5*a* is not separated from the transport roller 4*a*, the sequence waits until said sensor is turned on. On the other hand, if the release sensor 9 is on, indicating that the recording head 5*a* is separated from the transport roller 4*a*, a step S5 discriminates whether the sheet sensor 10 is on.

If the step S5 identifies that the sheet sensor 10 is off, indicating that the recording head 5*a* is separated from the transport roller 4*a* but the recording sheet 2 is not inserted into the entrance slot 3, this state is maintained and the sheet feeding operation is not started.

On the other hand, if the step S5 identifies that the sheet sensor is on, indicating that the recording head 5*a* is separated from the transport roller 4*a* and the recording sheet 2 has been inserted into the entrance slot 3, the sequence proceeds to a step S6 for starting the automatic feeding of the recording sheet 2.

Therefore, only when the recording head 5*a* is separated from the transport roller 4*a* and the recording sheet 2 has been inserted into the entrance slot 3, the mechanism detects such state and effects the automatic sheet feeding operation.

Then a step S6 resets the counter 13*d* (K = 0), and a step S7 drives the transport motor 4*d* by a step in the forward direction. Thus the transport roller 4*a* rotates in the forward direction, and the recording sheet 2 is advanced by the cooperation of the transport roller 4*a* and the pinch roller 4*b*.

Thereafter the transport motor 4*a* is activated in continuation, and, when a step S8 identifies that the registration sensor 11 is turned on, indicating that the leading end of the recording sheet 2 has reached the position of the registration sensor 11, the sequence proceeds to a step S9 for stepwise increasing the count of the counter 13*d* (K = K + 1). Then a step S10 discriminates whether the count K is equal to N, namely whether the transport motor 4*d* has been activated by N steps. When the count K reaches N, a step S11 stops the transport motor 4*d*.

Thus the leading end of the recording sheet 2 is advanced, from the position of the registration sensor 11 to a position corresponding to N steps of the transport motor 4*d*. The amount of sheet advancement by N steps of the transport motor 4*d* corresponds to the path length required for the leading end of the sheet 2 to travel from the position of the registration sensor 11 to the recording position by the recording head 5*a*. In this manner the leading end of the recording sheet 2 can be exactly positioned.

After the positioning of the leading end of the sheet, a step S12 activates the buzzer 16, for informing the operator of such positioning of the sheet end. Consequently the operator can securely know the completion of positioning of the leading end of the sheet 2.

After the activation of the buzzer 16 in the step S12, a step S13 discriminates whether the release sensor 9 is on. Thus, the recording operation is not started if the recording head 5*a* and the transport roller 4*a* are mutually separated by the release lever 6 after the positioning of the leading end of the recording sheet 2. If the operator manipulates the release lever in response to the signal of the buzzer 16 to return the recording head 5*a* and the transport roller 4*a* in mutually contacting state, thereby turning off the release sensor 9, the apparatus enters a recording standby state and starts the recording operation in response to recording signal.

On the other hand, if the release sensor 9 is turned off after the passing of the recording sheet 2 through the registration sensor 11 but before the step S10 identifies the n-step drives of the transport motor 4*d*, namely before the positioning of the leading end of the recording sheet 2, the sequence proceeds to steps S14–S16 to stop the transport motor 4*d* and to display an error message on the display B. Thus, if the recording head 5*a* and the transport roller 4*a* return to the mutually contacting state by some reason before the positioning of the leading end of the recording sheet 2, an error situation is identified and the sheet feeding operation is interrupted.

After the error message display in the step S16, the sequence returns to the step S14 whereby the sheet feeding operation is interrupted as long as the release sensor 9 is turned off. In this state the count of the counter 13*d* is stored.

When the release sensor 9 returns to the on state in the step S14, the sequence returns to the step S7, thereby activating the transport motor 4*d* and advancing the recording sheet 2 by N steps, starting from the stored count.

As explained in the foregoing, the setting operation of the recording sheet 2 does not apply a major load on the transport motor 4*d*, because the operation is conducted while the recording head 5*a* and the transport roller 4*a* are mutually separated. Consequently the transport motor 4d can be composed of a compact motor.

Also the setting operation of the recording sheet 2 can be easily achieved in one operation, since the transport motor 4a is automatically activated upon detecting the insertion of the recording sheet 2 into the entrance slot 3 during the released state.

[Another embodiment]

In the foregoing embodiment, if the released state is cancelled by an erroneous manipulation of the release lever in the course of positioning of the leading end of the recording sheet 2, the control means interrupts the sheet feeding and re-starts the positioning operation of the recording sheet 2 when the released state is restored. However it is also possible to adopt the sequence shown in FIG. 9.

Figure 8A:
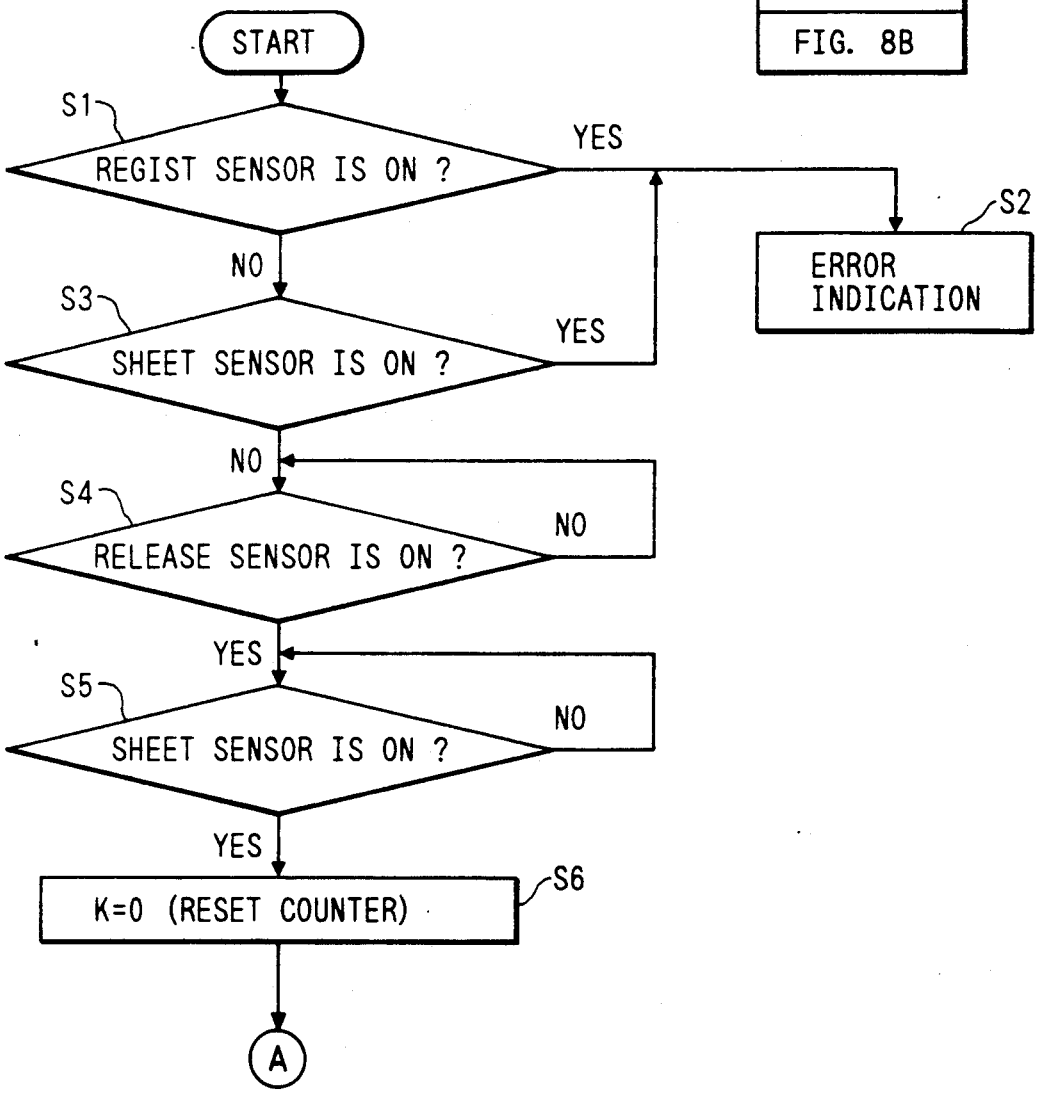
FIGS. 8 and 9 are flow charts of the sequence of a sheet feeding operation with FIGS. 8A, 8B and 9A, 9B being detailed flow charts thereof.
Figure 8:
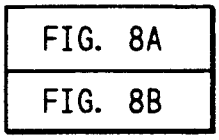
Figure 8B:
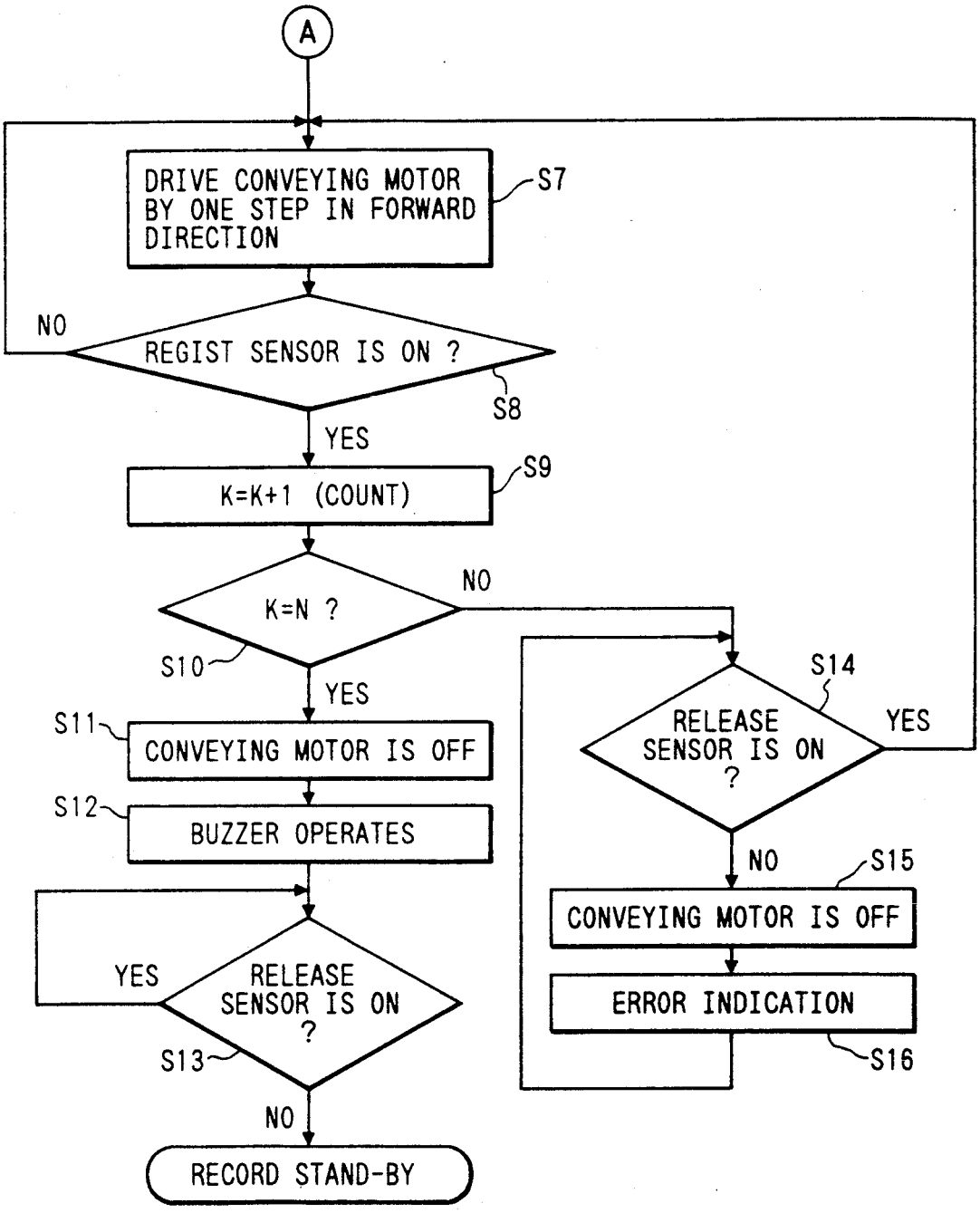
Figures 9, 9A:
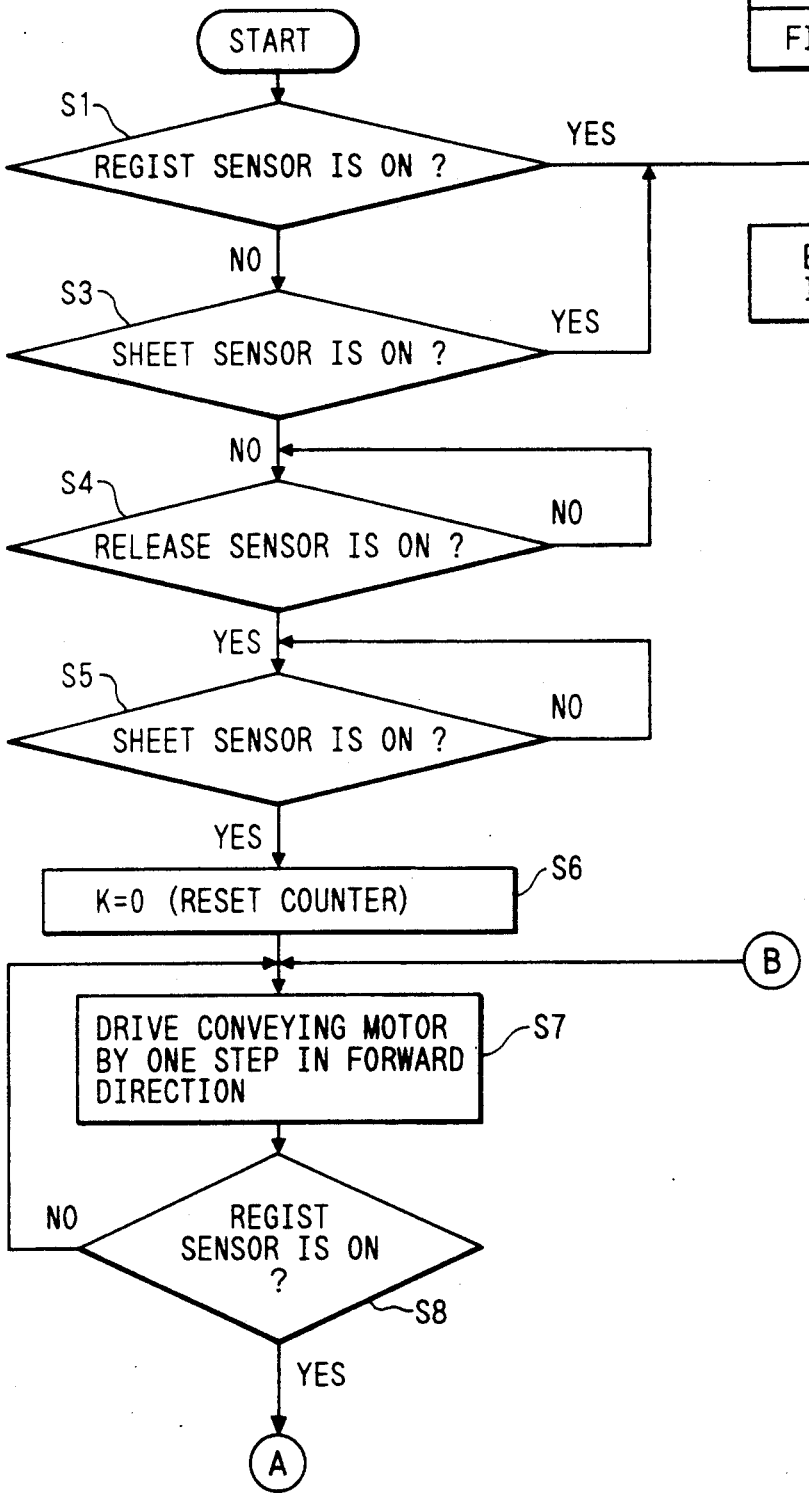
Figure 9B:
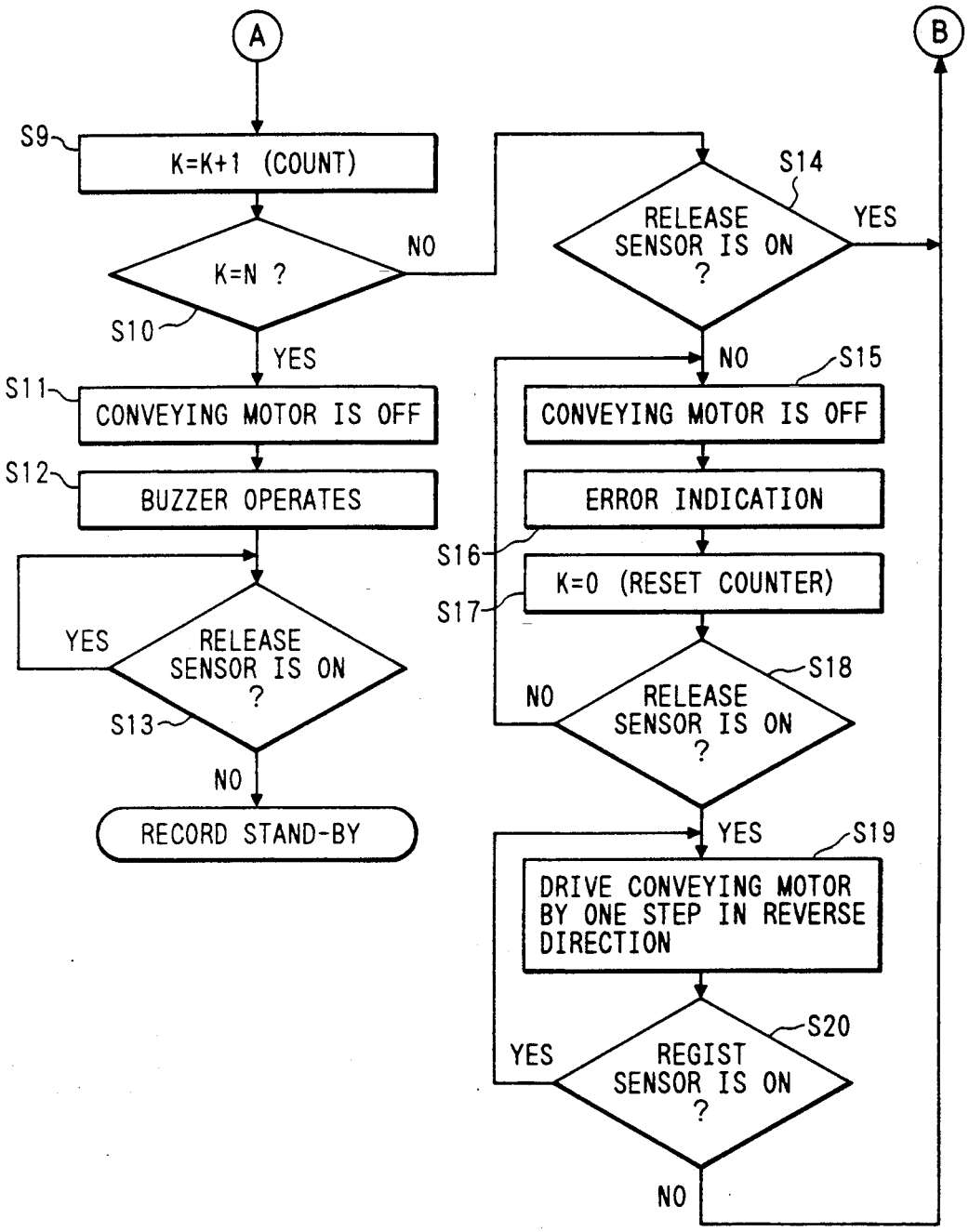

The flow chart shown in FIG. 9 is identical, from the step S1 to step S16, with the control sequence shown in FIG. 8.

In the present embodiment, after the error message display in the step S16, a step S17 resets the counter 13d, and a step S18 discriminates whether the release sensor 9 is on. If it is off, the sequence returns to the step S15. If it is on, indicating that the recording head 5a and the transport roller 4a have returned to the mutually separated state, the sequence proceeds to a step S19 for activating the transport motor 19 by a step in the reverse direction, thereby reversing the recording sheet 2. When a step S20 identifies that the registration sensor 11 has been turned off, namely when the leading end of the recording sheet 2 has been retracted to the upstream side beyond the registration sensor 11, the sequence returns to the step S7 for starting again the positioning operation of the leading end from such state.

Such sequence enables exact positioning of the leading head even when the position of the leading end has accidentally moved during the interruption of the sheet feeding operation.

In the foregoing embodiments shown in FIGS. 8 and 9, the step S3 effects an error message display if the recording sheet 2 is present at the position of the sheet sensor 10. In this case, the sheet feeding operation does not start by the manipulation of the release lever 6 for separating the recording head 5a and the transport roller 4a, if the recording sheet 2 is inserted into the entrance slot 3 at first. It is therefore also possible to remove the step S3 from the flow charts shown in FIGS. 8 and 9, whereby the sequence proceeds to the step S4 if the step S1 identifies that the registration sensor 11 is off.

Automatic sheet feeding is thus rendered possible even when the release lever 6 is manipulated after the recording sheet 2 is inserted into the entrance slot 3.

Also in the foregoing embodiments the leading end of the recording sheet 2 is set by transportation of a predetermined amount from the position of the registration sensor 11, but, for arbitrary setting of the record starting position, it is also possible to drive the transport motor 4d when the sheet sensor 10 and the release sensor 9 are both on, thereby feeding the recording sheet, and to stop the transport motor 4d when the release sensor 9 is turned off by the returning of the release lever 6. In this manner the record start position on the recording sheet can be suitably selected by returning the release lever 6 when the recording sheet 2 is advanced by a suitable amount.

Figure 10:
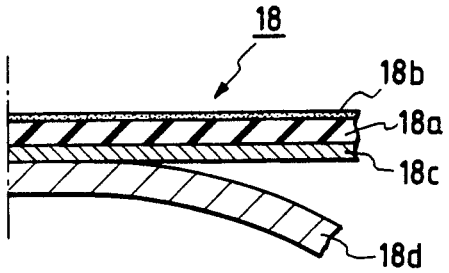
FIG. 10 is a schematic view of another embodiment of the recording sheet.

In the foregoing embodiments the recording sheet 2 is composed of ordinary thermosensitive sheet, but the present invention is limited to such embodiments. For example the recording sheet may be composed of so-called copying sheets, which, as shown in FIG. 10, are composed of a base sheet 10a coated with a thermosensitive color generating material 18b on the top surface thereof and with thermofusible ink 18a on the bottom surface thereof, and an image receiving sheet 18d laminated on the bottom surface of the base sheet 18a. The sheets 18 provides thermosensitive recording on the base sheet 18a and heat transfer recording on the receiving sheet 18d in a single recording operation.

Also in the foregoing embodiments, the releasing means is composed of a release lever 6, but the means may be composed of a rotary knob or a depressible button.

Furthermore the recording means is not limited to thermal recording method but may instead employ other recording methods, such as electrostatic discharge recording electrostatic recording or ink jet recording, particularly bubble jet recording proposed by the present applicant, in which the ink discharge is caused by the change of state induced by the heat generated by an electrothermal converter.

Furthermore, the foregoing embodiments employ the buzzer 16 for informing the setting of the recording sheet 2, but it is also possible to flash an indicator lamp or to display a message on the display B.

Furthermore, the foregoing embodiments have been limited to the application to a handy terminal, but the recording apparatus of the aforementioned structure may be applied to other recording apparatus, such as an electronic typewriter, a facsimile apparatus, a copying apparatus, a word processor or a printer.

Figure 11:
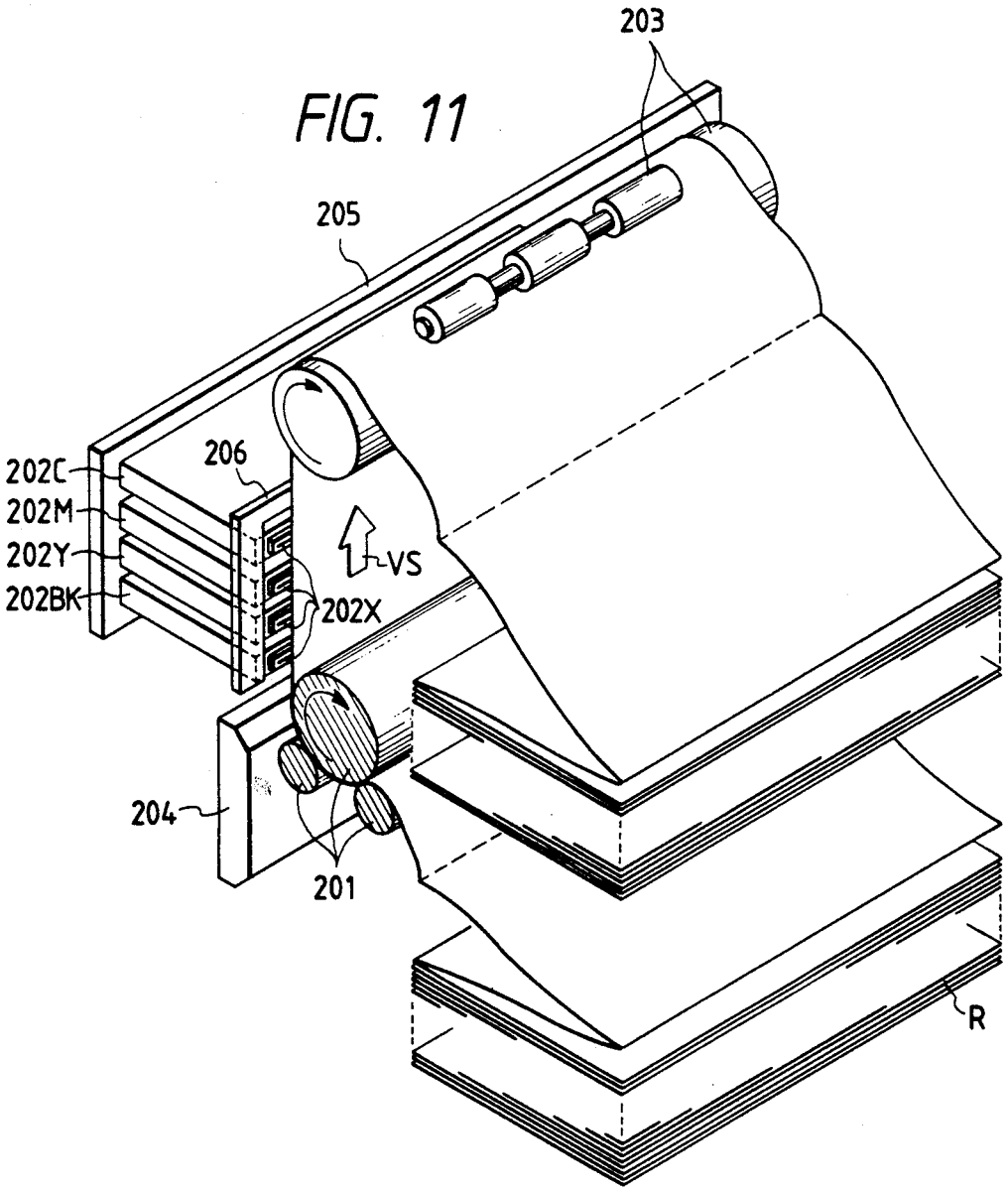
FIG. 11 is a perspective view of an ink jet recording apparatus embodying the present invention.

In the following there will be explained an ink jet recording apparatus in which the present invention is applied, with reference to FIG. 11. In the ink jet recording apparatus of the present embodiment, a gap of about 0.3 to 0.8 mm is present between the recording sheet and discharge openings 202X of heads 202C, M, Y, Bk to be explained later, but the present invention can be effectively applied in the feeding of the recording sheet because said gap is small.

The present embodiment is composed of a multicolor ink jet recording apparatus having plural full-multi type recording heads 202C, 202M, 202Y and 202Bk, which are arranged in mutually parallel manner and are adapted to respectively discharge cyan, magenta, yellow and black inks toward a recording sheet R at predetermined timings. Image recording is achieved on the recording sheet R, by the movement thereof in synchronization with the ink discharges. In the present embodiment, the recording sheet R is composed of a foldable continuous sheet. There are provided paired sheet feeding rollers 201, and sheet discharge rollers 203 for supporting the continuous sheet R in the recording position in cooperation with the feeding rollers 201 and advancing the sheet R in the direction of arrow by means of unrepresented drive means and in linkage with the sheet feeding rollers 201. Capping means 204 is adapted to be elevated and to cover the discharge openings 202X retracted from the recording position. In the present embodiment, the recording heads 202C, 202M, 202Y, 202Bk are integrally supported by a head holder 205, which is biased, as in the foregoing embodiments, by torsion coil springs (not shown) mounted on a shaft (not shown) whereby the front ends of lateral end portions of the head engage with stoppers 206. In this state the discharge openings 202X of the heads 202 and the recording sheet R are maintained at a predetermined gap required for recording. In the present embodiment, the stoppers 206 are provided with release means (not shown) for releasing the heads 202 from the stoppers 206. The release means is provided with a locking projection (not shown) and a releasing projection (not shown), either of which comes into contact with the head holder 205 to retract the heads from the recording position, thereby forming a gap therebetween enough for feeding the recording sheet R.

Among ink jet recording methods, the present invention is particularly effective in combination with the recording head or recording apparatus of so-called bubble ink jet recording method proposed by the present applicant, since such method is adapted for achieving a higher density or a higher definition in the recording.

The structure and working principle preferably follow the basic principle disclosed for example in the U.S. Pat. Nos. 4,723,129 and 4,740,796. This method is applicable to so-called on-demand type or continuous type recording, but is particularly advantageous in the on-demand recording, since a bubble can be formed in the liquid ink in 1:1 correspondence to the drive signal, by giving at least a drive signal corresponding to the recording information and inducing a rapid temperature increase exceeding the nucleus boiling, to an electrothermal converter positioned in each sheet or liquid path holding the liquid ink, thereby generating thermal energy in the electrothermal converter and generating film boiling on a heat action plane of the recording head. The liquid ink is discharged from the discharge opening by the expansion or contraction of the bubble, thereby forming at least a liquid droplet. The drive signal is preferably formed as a pulse, since the expansion or contraction of the bubble can be made instantaneously, whereby the liquid ink discharge can be achieved in highly responsive manner. Such pulse-shaped drive signal is preferably that disclosed in the U.S. Pat. Nos. 4,463,359 and 4,345,262. The recording can be further improved by employing the conditions disclosed in the U.S. Pat. No. 4,313,124 concerning the temperature increasing rate of the heat action plane.

The structure of the recording head includes not only the combinations of discharge openings, liquid paths and electrothermal converters as disclosed in the above-mentioned patents (linear or rectangularly bent liquid path), but also the structure in which the thermal action part is provided at a bent portion, as disclosed in the U.S. Pat. Nos. 4,558,333 and 4,459,600. Furthermore the present invention is effective in a structure disclosed in the Japanese Laid-open Patent Application No. 59-123670 in which a discharge opening is formed by a slit used commonly for plural electrothermal converters, or a structure disclosed in the Japanese Laid-open Patent Application No. 59-138461 in which an opening for absorbing the pressure wave of thermal energy is provided corresponding to the discharge opening. In summary, the present invention enables secure and efficient recording, regardless of the form of the recording head.

The recording apparatus of the present invention is preferably provided with recovery means for the recording head or other auxiliary means, in order to further stabilize the effect of the present invention. More specifically, for achieving stable recording operation, effectively employed is capping means, cleaning means, pressurizing or suction means for the recording head, or preliminary heating means employing the electrothermal converters and/or other heating elements, or a preliminary ink discharge mode for effecting an ink discharge separate from that for recording.

Also the number of the recording head is not limited to one, corresponding to a single-colored ink. There may be provided plural recording heads corresponding to plural inks of different colors or different densities. Thus the present invention is extremely effective not only in the apparatus with a recording mode with a main color such as black, but also in an apparatus capable of recording a plural-color image or a full-color image either by an integral recording head or by plural recording heads.

Furthermore, the ink in the foregoing description is assumed to be liquid, but there may also be employed ink which is solid at room temperature or at lower temperature but softens or liquefies at room temperature, or which is in liquid state when the recording signal is applied since, in the ink jet recording method, the ink temperature is usually controlled within a range from 30° to 70° C. for stabilizing the ink viscosity. Furthermore the present invention is applicable also to a method of liquefying and discharging the solid ink by the thermal energy corresponding to the recording signal, in which the solid ink is used for avoiding temperature increase by dissipating the thermal energy in the state change from solid to liquid, or for preventing the ink evaporation, or a method of utilizing ink that starts to solidify when it reaches the recording medium. In such methods, the ink may be supported in the liquid or solid state in a recess or penetrating holes of a porous sheet, opposed to the electrothermal converter, as disclosed in the Japanese Laid-open Patent Applications Nos. 54-56847 and 60-71260. In the present invention most effective is the above-mentioned method utilizing membrane boiling, for various inks mentioned above.

As explained in the foregoing embodiments, when the recording sheet is inserted after the recording means is released from the sheet transport means by detected and the transport means is automatically activated to set the recording sheet. Consequently the recording sheet can be automatically fed by the manipulation of the release means only and the operability at sheet setting can be improved.

Also the positioning of the leading end of the recording sheet can be exactly achieved by detecting the leading end of said sheet in feeding operation and advancing it by a predetermined amount.

Also the feeding operation is not conducted after the recording sheet is once set, even when the recording sheet is inserted again. Also the recording operation is not conducted when the recording means is in the released state. In this manner the erroneous operations can be prevented.

Furthermore, as explained in the foregoing embodiments, when the recording sheet is set while the recording means is released from the transport means by the release means but is not locked by the release means, the released state is automatically cancelled after the sheet setting. The recording means can also be locked in the released state, whereby the operator can use both hands for example in removing the jammed recording sheet.

The release means can be composed of a rotatable lever which can assume a locked state and an unlocked state according to the direction of rotation, thereby avoiding the increase in the number of component parts and achieving cost reduction.

Furthermore the operation state of the release means can be detected by a single sensor, and the transport means and the recording means can be operated according to the result of the detection, whereby failures in operation can be prevented without increase in the number of the sensor.

Also in the foregoing embodiments, the sheet feeding operation is interrupted if the released state of the recording means and the transport means is cancelled in the course of sheet setting operation, whereby a sudden change in the load of a motor for driving the transport means can be prevented.

Besides the amount of sheet feeding at the interruption is memorized, so that the sheet feeding operation can be continued when the released state is restored.

Furthermore, when the operation of the transport means is interrupted, it is also possible to reverse the leading end of the recording sheet to a predetermined position and re-start the positioning operation from the predetermined position, whereby exact positioning of the recording sheet can be achieved even if the recording sheet is displaced for some reason during the interruption.

As explained detailedly in the foregoing, the present invention can provide a recording apparatus with improved operability at the setting of recording sheet.

I claim:

1. A recording apparatus for recording on a recording medium, said apparatus comprising:

a conveying mechanism for conveying said recording medium;

a recording device for recording an image on the recording medium in a state that said recording device presses the recording medium to said conveying mechanism;

a releasing mechanism for releasing said recording means from said conveying mechanism;

a first detector for detecting an operational status of said releasing mechanism;

a second detector for detecting the recording medium; and an adjusting mechanism for driving said conveying mechanism to feed the recording medium when said first detector detects a released status of said recording device from said conveying mechanism and said second detector detects the recording medium.

2. An apparatus according to claim 1, wherein said recording device includes a recording head having a heat generating element.

3. An apparatus according to claim 1, wherein said recording device is an ink jet recording head for discharging ink from a discharge port utilizing growth of an air bubble effected upon heat generation of a heat generating element.

4. A recording apparatus for recording on a recording medium, said apparatus comprising:

a conveying mechanism for conveying the recording medium;

a recording device for recording on the recording medium in a state that said recording device presses the recording medium to said conveying mechanism;

a releasing mechanism for releasing said recording device from said conveying mechanism, said releasing mechanism being capable of having a first mode for keeping said recording device released from said conveying mechanism and a second mode for not keeping said recording device released from said conveying mechanism;

a first detector for detecting said first mode and said second mode of said releasing mechanism;

a second detector for detecting the recording medium; and an adjusting mechanism for driving said conveying mechanism to feed the recording medium when said first detector detects a released status of said recording device from said conveying mechanism.

5. An apparatus according to claim 4, wherein said recording section is an ink jet recording head for discharging ink from a discharge port utilizing growth of an air bubble effected upon heat generation of a heat generating element.

6. A recording apparatus for recording on a recording medium, said apparatus comprising:

a conveying mechanism for conveying the recording medium;

a recording device for recording on the recording medium in a state that said recording device presses the recording medium to said conveying mechanism;

a releasing mechanism for releasing said recording device from said conveying mechanism, said releasing mechanism being capable of having a first mode for keeping said recording device released from said conveying mechanism and a second mode for not keeping said recording device released from said conveying mechanism, a first detector for detecting said first mode and said second mode of said releasing mechanism;

a second detector for detecting the recording medium; and an adjusting mechanism for not allowing said recording device to record on the recording medium when said first detector detects a released status of said recording device from said conveying mechanism.

7. An apparatus according to claim 6, wherein said recording device includes a recording head having a heat generating element.

8. An apparatus according to claim 6, wherein said recording device is an ink jet recording head for discharging ink from a discharge port utilizing growth of an air bubble effected upon heat generation of a heat generating element.

9. A recording apparatus for recording on a recording medium, said apparatus comprising:

a conveying mechanism for conveying the recording medium;

a recording device for recording on the recording medium in a state that said recording device presses the recording medium against said conveying mechanism;

a releasing mechanism for releasing said recording device from said conveying mechanism;

a first detector for detecting an operational status of said releasing mechanism;

a second detector for detecting the recording medium;

a third detector for detecting a leading end of the recording medium conveyed by said conveying mechanism;

an adjusting mechanism for driving said conveying mechanism to feed the recording medium in response to the detection results of said third detector when said first detector detects a released status of said recording device from said conveying mechanism and said second detector detects the recording medium.

10. An apparatus according to claim 9, further comprising an informing mechanism for informing an end of conveyance of the recording medium by a predetermined amount.

11. An apparatus according to claim 9, wherein said adjusting mechanism does not drive said recording device when in a state where said recording device is kept released from said conveying mechanism after conveying the recording medium by a predetermined amount.

12. An apparatus according to any of claims 10 to 11 wherein the recording medium is conveyed by the predetermined amount until a leading end of the recording medium is fed to a recording position at which said recording device records.

13. An apparatus according to claim 9, wherein said recording device includes a recording head having a heat generating element.

14. An apparatus according to claim 9, wherein said recording device is an ink jet recording head for discharging ink from a discharge port utilizing growth of an air bubble effected upon heat generation of a heat generating element.

15. A recording apparatus for recording on a recording medium, said apparatus comprising:

a conveying mechanism for conveying the recording medium;

a recording device for recording on the recording medium in a state that said recording device presses the recording medium against said conveying mechanism;

a releasing mechanism for releasing said recording device from said conveying mechanism;

a first detector for detecting an operational status of said releasing mechanism;

a second detector for detecting the recording medium;

a third detector for detecting a leading end of the recording medium conveyed by said conveying mechanism; and an adjusting mechanism for driving said conveying mechanism to feed the recording medium in a reverse direction to a predetermined position and then feed the recording medium by a predetermined amount from said predetermined position in response to the detection results of said third detector when said first detector detects a released status of said recording device from said conveying mechanism and said second detector detects the recording medium.

16. An apparatus according to claim 15, further comprising an informing mechanism for informing an end of conveyance of the recording medium by a predetermined amount.

17. An apparatus according to claim 15, wherein said adjusting mechanism does not drive said recording device when in a state where said recording device is kept released from said conveying mechanism after conveying the recording medium by said predetermined amount.

18. An apparatus according to any of claim 15 to 17, wherein the recording medium is conveyed by the predetermined amount until a leading end of the recording medium is fed to a recording position at which said recording device records.

19. An apparatus according to claim 15, wherein said recording device includes a recording head having a heat generating element.

20. An apparatus according to claim 15, wherein said recording device is an ink jet recording head for discharging ink from a discharge port utilizing growth of an air bubble effected upon heat generation of a heat generating element.

21. A recording method for recording on a recording medium by utilizing a recording apparatus, said apparatus comprising:

a conveying mechanism for conveying the recording medium;

a recording device for recording on the recording medium in a state that said recording device presses the recording medium against said conveying mechanism;

a releasing mechanism for releasing said recording device from said conveying mechanism;

a first detector for detecting an operational status of said releasing mechanism;

a second detector for detecting the recording medium;

a third detector for detecting a leading end of the recording medium conveyed by said conveying mechanism; and an adjusting mechanism for driving said conveying mechanism to feed the recording medium in a reverse direction to a predetermined position and then feed the recording medium by a predetermined amount from said predetermined position in response to the detection results of said third detector when said first detector detects a released status of said recording device from said conveying mechanism and said second detector detects the recording medium.

* * * * *

UNITED STATES PATENT AND TRADEMARK OFFICE

CERTIFICATE OF CORRECTION

PATENT NO. : 5,133,611

DATED : July 28, 1992

INVENTOR(S) : Masuyuki NAKAJIMA

It is certified that error appears in the above-identified patent and that said Letters Patent is hereby corrected as shown below:

ON THE TITLE PAGE

[30] FOREIGN APPLICATION PRIORITY DATA

Insert: --Oct. 19, 1990 [JP] Japan ... 2-279335--.

COLUMN 4

Line 66, "the" should read --The--.

COLUMN 12

Line 42, "by detected" should read --by the manipulation of the release means, such insertion is detected--.

COLUMN 13

Line 28, "of" should read --of the--.

UNITED STATES PATENT AND TRADEMARK OFFICE

CERTIFICATE OF CORRECTION

PATENT NO. : 5,133,611

DATED : July 28, 1992

INVENTOR(S) : Masuyuki NAKAJIMA

It is certified that error appears in the above-identified patent and that said Letters Patent is hereby corrected as shown below:

COLUMN 14

Line 32, "mechanism," should read --mechanism;--.

COLUMN 16

Line 13, "claim" should read --claims--.

Signed and Sealed this

Twenty-first Day of September, 1993

Bruce Lehman

*Attest:*

BRUCE LEHMAN

*Attesting Officer*

*Commissioner of Patents and Trademarks*